US006769362B2

(12) United States Patent
Okubo et al.

(10) Patent No.: US 6,769,362 B2
(45) Date of Patent: Aug. 3, 2004

(54) PRINTING BLANKET

(75) Inventors: Hiromasa Okubo, Kobe (JP); Toshikazu Kinoshita, Kobe (JP); Seiji Tomono, Kobe (JP)

(73) Assignees: Sumitomo Rubber Industries, Ltd., Kobe (JP); Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/095,697

(22) Filed: Mar. 13, 2002

(65) Prior Publication Data

US 2002/0134264 A1 Sep. 26, 2002

Related U.S. Application Data

(62) Division of application No. 09/657,815, filed on Sep. 8, 2000.

(30) Foreign Application Priority Data

Sep. 10, 1999 (JP) ..... 11-257538
Jul. 17, 2000 (JP) ..... 2000-216210

(51) Int. Cl.[7] ..... B41F 13/10; B41F 5/00; B41N 6/00

(52) U.S. Cl. ..... 101/375; 101/376; 101/401.1; 101/271; 101/217; 101/216; 101/382

(58) Field of Search ..... 101/375, 376, 101/401.1, 271, 217, 216, 382; 428/218

(56) References Cited

U.S. PATENT DOCUMENTS

| | | | | |
|---|---|---|---|---|
| 4,144,813 A | * | 3/1979 | Julian | 101/382 |
| 4,255,508 A | * | 3/1981 | Kuehnle | 430/94 |
| 4,601,928 A | | 7/1986 | van der Velden | |
| 5,323,702 A | | 6/1994 | Vrotacoe et al. | |
| 5,351,615 A | | 10/1994 | Kobler et al. | |
| 5,429,048 A | | 7/1995 | Gaffney et al. | |
| 5,431,989 A | * | 7/1995 | Beltzung et al. | 428/218 |
| 5,440,981 A | | 8/1995 | Vrotacoe et al. | |
| 5,478,637 A | | 12/1995 | Tomono et al. | |
| 5,768,990 A | | 6/1998 | Vrotacoe et al. | |
| 5,832,824 A | | 11/1998 | Okubo et al. | |
| 5,934,192 A | | 8/1999 | Ogita et al. | |
| 6,019,042 A | | 2/2000 | Batti et al. | |

FOREIGN PATENT DOCUMENTS

| | | |
|---|---|---|
| JP | 5301483 A | 11/1993 |
| JP | 1058853 | 3/1998 |

* cited by examiner

*Primary Examiner*—Andrew H. Hirshfeld
*Assistant Examiner*—Marvin P. Crenshaw
(74) *Attorney, Agent, or Firm*—Birch, Stewart, Kolasch & Birch, LLP

(57) ABSTRACT

The present invention provides a cylindrical printing blanket comprising a seamless sleeve and a sheet-like blanket having a fabric layer, a compressive layer and a surface printing layer, said sheet-like blanket being bonded onto the outer surface of said seamless sleeve. The blanket is made by cutting a long sheet-like blanket that has the fabric layer, the compressive layer and the surface printing layer and is bonded to the outer surface of the seamless sleeve, thus the operation can be done with good workability.

7 Claims, 3 Drawing Sheets

PRINTING BLANKET

This application is a divisional of co-pending application Ser. No. 09/657,815, filed on Sep. 8, 2000, the entire contents of which are hereby incorporated by reference and for which priority is claimed under 35 U.S.C. §120; and this application claims priority of Application No. 11-257538 and 2000-216210 filed in Japan on Sep. 10, 1999 and Jul. 17, 2000, respectively under 35 U.S.C. §119.

BACKGROUND OF THE INVENTION

The present invention relates to a cylindrical printing blanket that has high durability and high productivity and is particularly suited to high-speed offset printing.

Various types of printing blanket have been developed and used. One example is a sheet-like blanket made by laminating a base fabric layer, a compressive layer made of a porous oil-resistant rubber, a top layer fabric and NBR (acrylonitrile-butadiene copolymer rubber) oil-resistant rubber. This sheet-like blanket is set on a cylinder by fitting tabs attached on both ends of the blanket into gaps formed in the printer cylinder, pulling the tabs on both ends by means of a take-up mechanism that is incorporated in the cylinder thereby applying a tension to the blanket.

However, the sheet-like blanket has such problems as 1) vibration occurs when the gap passes through a nip during rotation of the printer cylinder, resulting in such defects of the printing quality as shock-streak and making high-speed printing at 1000 rpm or higher impossible; 2) it takes as long as 30 minutes to exchange the blanket leading to a low efficiency of changing operation; and 3) setting the blanket on the cylinder while applying tension thereto tends to cause set in fatigue and thinning of the blanket due to the tension that is constantly applied thereto.

To avoid the problems, a cylindrical printing blanket having no seam in the circumferential direction was developed. This printing blanket has such a general structure that a compressive layer made of a porous oil-resistant rubber which has no seam, a non-elastic layer and a surface printing layer made of NBR oil-resistant rubber which has no seam are laminated in this order, via a seamless adhesive layer made of an elastomer, on the outer surface of a cylindrical sleeve that is put on a blanket cylinder from the outside (Japanese Published Unexamined Patent Application (Kokai Tokkyo Koho Hei) 5-301483). The cylindrical blanket is used while being put on a printer cylinder that does not have gaps. The sleeve has an inner diameter that is equal to or slightly smaller than the outer diameter of the cylinder and is normally engaged firmly with the cylinder, but expands slightly in the radial direction when a pressure is applied from the inside and can be removed from the cylinder. The cylinder has air holes formed therein to supply a pressured gas onto the inner surface of the sleeve.

The cylindrical blanket has such advantages over the sheet-like blanket as: 1) structure of the printer cylinder without gap does not generate vibration during rotation and does not cause shock-streak on the printed matter, thereby making high-speed printing possible and achieving high productivity of printing; and 2) the blanket can be exchanged in a short time of one minute and does not require the adjustment of tension unlike the sheet-like blanket, thus allowing easy changing operation without requiring skill.

Use of the sheet-like blanket of the prior art in printing involves the problems 1) to 3) as described previously. The cylindrical blanket was developed for the purpose of solving the problems, but has the following problems left to be solved.

1) Influence on the Printing Quality

Although the shock-streak of the sheet-like blanket was solved by the use of the sleeve, the cylindrical blanket of the prior art has a thread layer made by winding a thread spirally around the circumference. The thread layer, also called the bearing layer, has the function of preventing a surface printing rubber layer and the compressive layer from experiencing shear deformation occurring in the direction of rotation during printing. The bearing layer has previously been called the stabilizer layer and has been recognized only to have the function described above. While the thread layer is a counterpart of the fabric layer in the case of the sheet-like blanket, the thread layer of the cylindrical blanket tends to cause a printing defect of an unintended density pattern being generated on the printed matter along the thread, due to winding of the thread around the circumference because the blanket is formed in a cylindrical shape. This is because the restricting force of the thread layer is weaker between adjacent lines of the thread, thus causing a difference in the shear deformation of the surface rubber that results in the unevenness in printing. When the surface printing rubber layer formed over the thread layer is made thicker for the purpose of preventing the problem described above, printing defects such as bulge and slur tend to occur.

2) Set in Fatigue of Compressive Layer

Set in fatigue due to tension as in the case of the sheet-like blanket does not occur in the blanket made in cylindrical shape with the different mounting mechanism. In the case of the cylindrical blanket, however, since the compressive rubber layer is always compressed by the thread layer formed by winding the thread with a tension around the compressive rubber layer, set in fatigue is likely to occur in the compressive layer.

3) Productivity of Manufacturing the Blanket

The sleeve-like blanket is difficult to manufacture in a long sheet of large width. Thus it is necessary to make in a plurality of laminated structure (a base layer, a compressive layer, a thread layer and a surface rubber layer) for each product, thus resulting in a low productivity.

SUMMARY OF THE INVENTION

An object of the present invention is to solve the problems of the cylindrical blanket of the prior art and to provide a cylindrical printing blanket that is capable of producing printed matters of high quality over a wide range from ordinary printing to high-speed printing, robust and easy to handle, has a long service life and allows easy reuse of the sleeve and other components.

In order to solve the problems described above, the present inventors have studied intensively about the structure of the cylindrical blanket, thus completing the present invention.

The present invention thus relates to the following printing blankets.

1) A cylindrical printing blanket comprising a seamless sleeve and a sheet-like blanket having a fabric layer, a compressive layer and a surface printing layer, said sheet-like blanket being bonded onto the outer surface of said seamless sleeve.

2) The cylindrical printing blanket according to the term 1) wherein said sheet-like blanket is bonded via a thread layer formed by winding a thread in spiral on a sleeve via an adhesive elastomer layer.

3) The cylindrical printing blanket according to the term 2), wherein a cylinder of diameter that is 0.05% to 1.0% smaller than that of a cylinder of a printing press whereon said cylindrical printing blanket is mounted is provided with a sleeve of a diameter equal to or slightly smaller than that of said cylinder being temporarily mounted thereon, and a thread is wound in spiral thereby providing an interference.

4) The cylindrical printing blanket according to the term 2), wherein a seam of said sheet-like blanket on the sleeve is processed to prevent a liquid from permeating at least through the end faces thereof.

5) The cylindrical printing blanket according to the term 4), wherein processing of the seam is to cover with a coat that does not allow liquid to permeate.

6) The cylindrical printing blanket according to the term 2), wherein a groove generated when said sheet-like blanket is bonded is filled with an elastomer.

7) The cylindrical printing blanket according to the term 6), which is filled with compressive elastomer.

The printing blanket of the present invention has the sheet-like blanket that comprises at least one fabric layer and a surface printing rubber layer is adhered onto the outer surface of the sleeve, while the seam is processed to prevent a liquid from penetrating therethrough.

In other words, the thread layer of the cylindrical printing blanket of the prior art, that is formed by winding the thread while applying a tension in a spiral as a bearing layer or stabilizer layer for the surface printing layer, is replaced by the fabric layer in the present invention. And the thread layer formed around the sleeve makes it easier to hold the sleeve on the cylinder in close contact therewith and also improves the durability of the sleeve. When the thread layer is provided directly on the sleeve via an adhesive layer, it is made easier to process and handle such as adhesion of the sheet-like blanket.

In contrast to the cylindrical printing blanket of the prior art that is based on the concept of giving the functions of holding onto the cylinder and durability against cracks and other defects to the sleeve itself, the present invention has been completed upon finding of important functions of the thread layer.

The cylindrical printing blanket of the present invention has the following effects.

1) Better Printing Quality

Since the blanket is formed in a cylindrical shape, shock-streak will not be generated. The blanket of the present invention is mounted on a printer cylinder by aligning the seam of the printing plate and the seam of the blanket. Unlike the prior art, woven or non-woven fabric is used, instead of the thread layer, directly below the surface printing rubber layer, and a plain weave fabric layer is generally formed. As a result, unevenness in printing due to the surface unevenness of the threads is not produced.

2) Mitigation of Set in Fatigue

Since compressive force is not applied by the thread layer to the compressive layer unlike the cylindrical printing blanket of the prior art, less set in fatigue is caused. Also because tension is not constantly applied when mounted unlike the sheet-like blanket of the prior art, this also contributes to the mitigation of the set in fatigue.

3) Higher Productivity of Manufacturing

The printing blanket of the present invention can be manufactured in a long sheet of large width in a separate production line in advance, cutting the sheet to a proper size and bonding the cut sheet onto the sleeve that serves as a support. Thus the blanket can be manufactured with a very high production efficiency.

4) High Productivity of Printing

In the prior art, it has not been considered possible to use such a cylindrical blanket of a simple structure as that of the present invention in high-speed printing. However, it was found that higher durability can be achieved by using such a structure as the sleeve is held by the thread layer. Even when the amount of printing per unit blanket is a little less than in the case of the conventional blanket, high productivity of manufacturing the blanket makes it possible to increase the amount of printing that can be made per unit price.

DESCRIPTION OF REFERENCE NUMERALS

Figure 1:
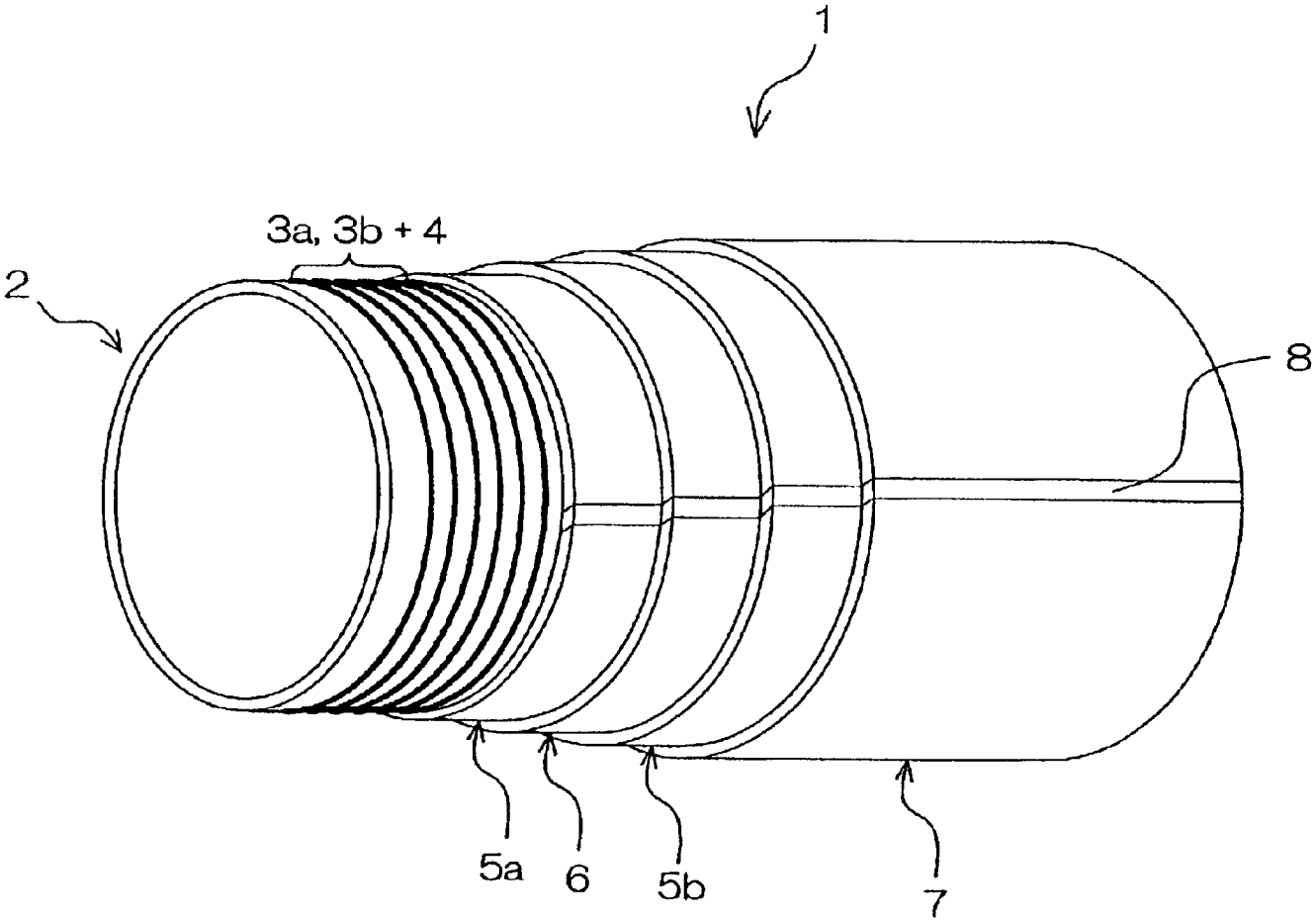
FIG. 1 is a partially cutaway perspective view showing an example of the printing blanket according to the present invention.

1: Printing blanket
2: Cylindrical Sleeve
3*a* to 3*h*: Adhesive layers
4: Thread layer
5*a*, 5*b*: Fabric layer
6: Compressive layer
7: Surface printing rubber layer
8: Seam
9: Filling elastomer

MODE FOR CARRYING OUT THE INVENTION

A cylindrical printing blanket 1 of the present invention has a basic structure of bonding a sheet-like blanket member S consisting of a fabric layer 5, a compressive layer 6 and a surface printing rubber layer 7 around a sleeve 2. The sheet-like blanket member S is usually attached via a thread layer 4 that is formed by winding a thread in spiral around the sleeve 2.

Figure 2:
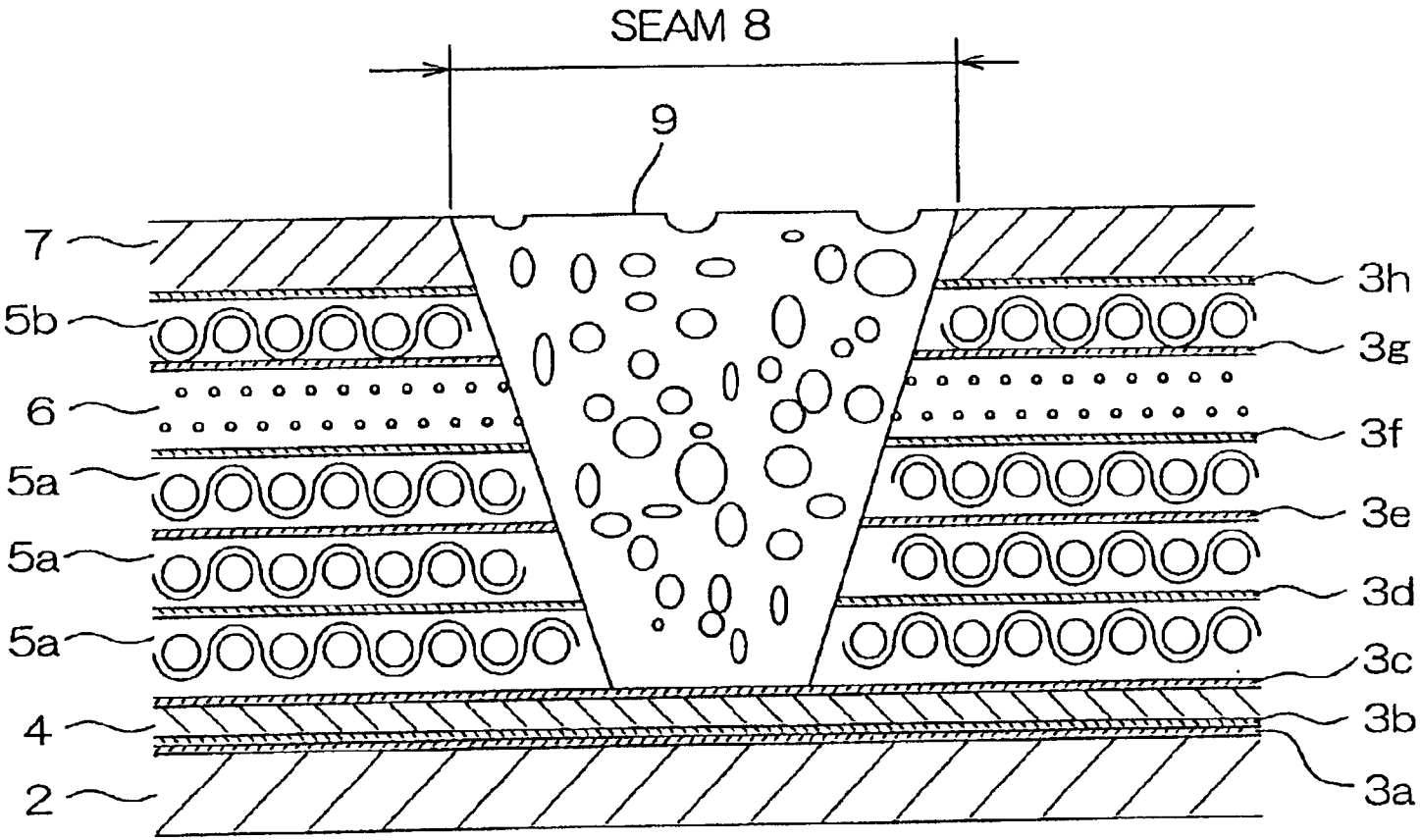
FIG. 2 is a sectional view of the printing blanket shown in FIG. 1.

The printing blanket will be described below with reference to drawings that show an embodiment thereof. FIG. 1 is a partially cutaway perspective view showing an embodiment of the printing blanket of the present invention. FIG. 2 is a sectional view of the printing blanket shown in FIG. 1.

(1) Formation of Adhesive Layer and Thread Layer on the Sleeve

Sleeve 2

The sleeve has a diameter that is equal to or slightly smaller than the outer diameter of the blanket cylinder and is normally engaged firmly with the blanket cylinder, but expands slightly in the radial direction when a pressure is applied from the inside and can be removed from the blanket cylinder. The blanket cylinder has air holes formed therein to supply pressured gas therethrough onto the inner surface of the sleeve.

For the cylindrical sleeve 2 of the printing blanket according to the present invention, various known sleeves of the prior art may be employed such as a seamless metal sleeve with very small wall thickness and a sleeve made of glass fiber-reinforced plastics. Particularly, a sleeve made of nickel having thickness of about 0.15 mm is preferably used in consideration of the rigidity, strength and elasticity thereof.

Adhesive Layers 3*a*, 3*b*

Before forming the thread layer 4 on the sleeve 2, bonding process is applied and an adhesive layer 3*a* is formed. In case the sleeve 2 is made of a metal, for example, a layer of an adhesive that shows better adhesion with the metal and with an adhesive elastomer layer 3*b*, that is formed below the thread layer 4, is preferably used for the adhesive layer 3*a*.

For such an adhesive, it is preferable to use an adhesive that adheres well particularly with the metal and an adhesive that adheres well particularly with the elastomer, in combination. Specifically, an adhesive layer of two-layer structure is formed by applying an adhesive that adheres well particularly to the metal using a doctor blade, a doctor roll or the like to the surface of the sleeve 2 and, after drying, applying an adhesive that adheres well particularly to the elastomer layer 3*b* similarly, which is then dried. The adhesive elastomer layer 3*b* is made of an elastomer that includes an oil-resistant polymer such as NBR as the major component.

Of the two kinds of adhesive that constitute the adhesive layer of two-layer structure, the former one that has good adhesive characteristic with the metal may be manufactured by Lord Chemical Inc. under the trade name of Chemlock 205, although not limited to this.

More preferably, the adhesive layer 3*a* consists of two adhesive layers 3*a*-1, 3*a*-2, made by applying 3*a*-1 that adheres well to the metal and 3*a*-1 that adheres well to the elastomer on the nickel sleeve in this order, and the adhesive elastomer layer 3*b* is formed thereon. In this case, Chemlock 205 and Chemlock 252X may be used as 3*a*-1 and 3*a*-2, respectively.

While there is no limitation to the thickness of the adhesive layer, total thickness of the two layers in the case of the two-layer structure is preferably in a range from 0.02 to 0.25 mm. When thickness of the adhesive layer is less than this range, sufficient bonding strength may not be achieved and, when the thickness is greater than this range, functions of the other layers may be impeded.

Thread Layer 4

Normally, the sleeve 2, that has the adhesive layer described above being formed thereon, is preferably provided with the thread layer 4 formed thereon. The thread layer is formed by winding the thread with a tension around the sleeve 2 that is put on the cylinder, it is preferable to make the diameter of the cylinder a little smaller than that of the printer cylinder whereon the blanket is to be mounted, namely to secure an interference. The interference is usually in a range from 0.05 to 1.0% and preferably in a range from 0.3 to 0.7%. The blanket 1 can be mounted so as not to slide on the printing cylinder by securing the interference and using the sleeve that has a uniform diameter and is made of homogeneous material. This method has an advantage over such a method, for example, as disclosed in Japanese Unexamined Patent Publication No. H10-58853 where a butt portion provided on the sleeve and a butt portion provided on the compressive layer are put into butt joint and it is difficult to prevent slip from occurring due to the accuracy of dimensions.

While the thread is selected in consideration of the workability of winding in spiral, compatibility with the adhesive layer 3*b*, tensile strength and other factors, usually cotton thread, polyester thread or rayon thread is preferably used.

Diameter of the thread is preferably in a range from 0.1 to 0.8 mm in general. A thread of diameter less than this range may make it difficult to wind in spiral. When the diameter is larger than this range, number of turns wound on one blanket becomes smaller and the effect of preventing slip decreases. Of the range described above, the thread diameter is preferably in a range from 0.15 to 0.60 mm, and more preferably in a range from 0.20 to 0.40 mm.

Although there is no limitation to the space between adjacent turns of winding when the thread is wound in spiral, the space is preferably not larger than 0.05 mm and it is more preferable that there is hardly any space between adjacent turns.

When the space between adjacent turns is larger than the range described above, adhesion to the fabric layer 5 of the sheet-like blanket (S) is likely to become uneven. Tension applied to the thread when being wound in spiral is preferably from 100 to 800 g, for example, when cotton thread is used. When the tension is lower than this range, it becomes difficult to wind the thread because different turns tend to overlap. Even when the thread can be wound without overlapping, the effect of preventing slip decreases. When the tension is higher than the range described above, on the other hand, the blanket tends to be stuck very firmly to the temporary mounting cylinder used for the manufacture of the blanket after winding the thread and becomes difficult to remove from the cylinder.

Of the range described above, tension applied to the thread when winding the thread in spiral is more preferably from 200 to 700 g, and even more preferably from 300 to 500 g.

The adhesive layers 3*b*, 3*c* and the thread layer 4 are formed into a single layer.

(2) Sheet-Like Blanket Member S

The sheet-like blanket member S of the present invention comprises a fabric layer 5*a*, the compressive layer 6, a fabric layer 5*b* and the surface printing rubber layer 7, that are usually laminated in this order in the preferable mode. The sheet-like blanket member S is attached to the outer surface of the sleeve by bonding the fabric layer 5 (5*a*) thereof and the thread layer 4 with the fabric layer 5 (5*b*) being provided between the compressive layer 6 and the surface printing rubber layer 7, although the fabric layer 5 (5*b*) may be omitted.

Fabric Layer 5*a*/5*b*

The fabric layer 5*a* of the fabric layer 5 is made by laminating one ore more, normally two to four, base fabrics onto the adhesive layer. FIG. 2 shows an example of laminating three base fabrics by means of adhesive layers 3*d*, 3*e*. Thickness of the fabric layer is normally in a range from 0.1 to 1.5 mm. Thickness of the fabric layer 5*b* provided between the compressive layer 6 and the surface printing rubber layer 7 is normally in a range from 0.1 to 0.5 mm.

For the base fabric, for example, woven fabric made of cotton, polyester or rayon is used. Impregnated rubber material may be, for example, acrylonitrile-butadiene copolymer rubber (NBR) or chloroprene (CR). The rubber material includes a predetermined quantity of a cross-linking agent, a cross-linking accelerating agent and, as required, a thickener. The rubber material is applied to the woven fabric with proper coating means such as blade coating process or the like.

Compressive Layer 6

The compressive layer 6 formed on the fabric layer 5*a* via the adhesive layer (adhesive layer 3*f* in the example of FIG. 2) is made of a porous material that has high vibration absorbing characteristic. The porous material may be of open-cell structure wherein pores in the layer communicate with each other or of closed-cell structure wherein the pores are formed independently from each other.

While there is no limitation to void ratio that represents the proportion of the volume of pores in the compressive layer 6 according to the present invention, void ratio is preferably in a range from 30 to 60%.

When void ratio in the compressive layer 6 is lower than the range described above, the compressive layer 6 may not have sufficient capability to absorb impact. When the void ratio of the compressive layer 6 is greater than the range described above, on the other hand, strength of the compressive layer 6 decreases resulting in increased possibility of the set in fatigue described previously, and service life of the printing blanket 1 may be shortened.

Of the range described above, void ratio in the compressive layer 6 is preferably in a range from 35 to 55%, and more preferably from 35 to 45%.

For the elastomer that constitutes the compressive layer 6, one that has high resistance to oil is preferably used. Specifically, various synthetic rubbers and thermoplastic elastomer may be used, and an elastomer that has greater effect of absorbing vibration and impact load with strong attenuation of vibration is particularly preferable. The elastomer is preferably also highly resistant to oil in order to be durable against printing oil. Examples of such elastomer are synthetic rubbers such as acrylonitrile-butadiene copolymer rubber (NBR), chloroprene rubber (CR) and urethane rubber (U).

Thickness of the compressive layer 6 is preferably in a range from 0.15 to 0.6 mm. When thickness of the compressive layer 6 is less than this range, the effect of the compressive layer 6 to absorb the pressure when a plate cylinder is pressure-joined decreases, thus making it more likely for the surface of the printing blanket 1 to experience significant deformation, so-called bulge, due to the pressure-joining of the plate cylinder. As a consequence, changing ratio of the circumferential length increases leading to lower printing quality including blurred printed image.

When thickness of the compressive layer 6 is larger than this range, on the other hand, contact pressure of the printing blanket 1 against the plate cylinder and paper decreases resulting in insufficient deposit of the ink in a solid portion of the printed image, namely a decrease in the so-called solid inking properties, leading to a possibility of fading in the solid portion. Also when printing, the layers constituting the blanket are likely to slide backward in the rotating direction of the printing blanket 1, giving rise to a possibility of positional difference in the transfer of ink during printing. Moreover, strength of the compressive layer 6 may decrease resulting in increased possibility of the set in fatigue described previously, and service life of the printing blanket 1 may be shortened.

Thickness of the compressive layer 6 is preferably in a range from 0.2 to 0.5 mm in the range described above, and more preferably in a range from 0.3 to 0.4 mm. In case the compressive layer 6 is made in open-cell structure, the so-called leaching process that employs a liquid-soluble substance is applied. In case the compressive layer 6 is made in closed-cell structure, non-expanded or expanded micro-balloons are used.

The open-cell structure is made in such a process as follows. First, a rubber cement, that is prepared by adding the various additive agents described previously and a water-soluble powder such as common salt to non-vulcanized rubber, is applied to the surface of the fabric layer 5*a* whereon the adhesive layer 3*b* has been formed with means such as doctor blade or doctor roll to form a coat of a he predetermined thickness, that is pressurized and heated to vulcanize thereby forming a vulcanized layer.

The vulcanized layer can also be formed by laminating a sheet made of an unvulcanized compound that includes the components described above on the surface of the fabric layer 5*a* whereon the adhesive layer 3*b* has been formed, and then vulcanizing the compound by heating.

The printing blanket 1 at the stage where the vulcanized rubber layer has been formed is immersed in hot water of a temperature from 60 to 100° C. for 6 to 10 hours, thereby to dissolve and remove the water-soluble powder. As the printing blanket 1 is dried sufficiently to remove water, the porous compressive layer 6 is formed with the water-soluble powder that has been removed leaving pores in the open-cell structure.

Void ratio of the compressive layer 6 formed by the leaching process is determined by the quantity of the water-soluble powder added to the rubber cement and the unvulcanized compound as will be understood from the foregoing description. That is, void ratio increases when a greater quantity of the water-soluble powder is added and decreases when a smaller quantity of the water-soluble powder is added. Thus such a quantity of the water-soluble powder that corresponds to the desired void ratio may be added to the rubber cement and the unvulcanized compound.

When the compressive layer 6 is formed in the closed-cell structure, the vulcanization process described above may be preferably employed wherein the micro-balloons are added to the rubber cement and the unvulcanized compound. The compressive layer 6 may also be expanded simultaneously with the vulcanization by adding a foaming agent.

Surface Printing Rubber Layer 7

For the elastomer that constitutes the surface printing rubber layer 7, one that has high resistance to oil as well as greater effect of absorbing vibration and impact load with strong attenuation of vibration is preferably used. Specifically, the same synthetic rubbers as those used for the compressive layer 6 may be used. Heavily vulcanized rubber and hydrogenated NBR may also be used.

Thickness of the surface printing rubber layer 7 is preferably in a range from 0.1 to 0.4 mm. When thickness of the surface printing rubber layer 7 is less than this range, insufficient deposit of the ink in a solid portion of the printed image leads to a possibility of fading in the solid portion.

When thickness of the surface printing rubber layer 7 is larger than this range, on the other hand, the surface printing rubber layer 7 experience greater slide backward in the direction of rotation and the changing ratio of the circumferential length increases accordingly, leading to lower printing quality including blurred printed image.

Thickness of the surface printing rubber layer 7 is preferably in a range from 0.1 to 0.3 mm, in particular, of the range described above, and more preferably in a range from 0.15 to 0.3 mm.

When the surface printing rubber layer 7 is formed from the synthetic rubber described above, such a process is employed as follows. First, a rubber cement, that is prepared by adding the various additive agents described previously to unvulcanized rubber, is applied to the surface of the compressive layer or the fabric layer 5*b* provided on the compressive layer (a case of providing the fabric layer 5*b* is shown in FIG. 2) with such means as doctor blade or doctor roll to form a coat of the predetermined thickness, that is pressurized and heated to vulcanize thereby forming a vulcanized layer.

The surface of the surface printing rubber layer 7 formed as described above is preferably polished and finished to a predetermined roughness and thickness.

Since the surface roughness of the surface printing rubber layer 7 is closely associated to the accuracy of printing, the surface must be finished particularly accurately. While there is no limitation to the surface roughness, it is preferably in a range from 1 to 10 μm in terms of ten-point average roughness (Rz). Of the range described above, surface roughness is preferably in a range from 2 to 8 μm and more preferably from 3 to 6 μm in terms of ten-point average roughness (Rz).

Adhesive Layers 3*f*, 3*h*

The adhesive layer 3*f* provided between the compressive layer 6 and the fabric layer 5*a* and the adhesive layer 3*h* provided between the fabric layer 5*b* and the surface printing rubber layer 7 are both preferably made of an elastomer, particularly a synthetic rubber that is highly resistant to oil.

Among the adhesive layers, the adhesive layer 3*f* is formed in such a process as a rubber cement including unvulcanized rubber of the synthetic rubber described above is applied to the surface of the fabric layer 5*a* with such means as doctor blade or doctor roll and is pressurized and heated to vulcanize when the compressive layer 6 is vulcanized.

While there is no limitation to the thickness of the adhesive layers 3*f*, 3*h*, the thickness is preferably in a range from 0.01 to 0.1 mm. When the thickness of either of the adhesive layers is less than this range, sufficient bonding strength may not be obtained and, when the thickness is greater than this range, functions of other layers may be impeded.

Joint 8

According to the present invention, the sheet-like blanket member S constituted as described above is bonded via the thread layer 4 of the sleeve 2. Usually, the sheet-like blanket that has been vulcanized to the surface printing rubber layer is used. As a result, both ends of the sheet-like blanket are joined with each other via a joint 8. The joint 8 is formed as a gap that has width of about 0.5 to 2 mm at the top as shown in FIG. 2.

It is necessary to process the gap to make it impermeable to at least liquid, in order to prevent liquids such as ink from penetrating therethrough. The process to make the gap impermeable is, for example, to apply silicone resin, fluorocarbon resin or the like in the state of liquid and drying, while heating as required. Or, alternatively, the gap may be filled with a material that is impermeable to liquids, such as rubber and thermoplastic resin. More preferably, the gap may be filled with a non-compressive or compressive elastomer 9 which is then washed thereby to prevent the ink from penetrating therethrough. The elastomer similar to that used for 3*b*, 3*f*, 3*h* is used. The elastomer 9 that fills the gap of the sheet is vulcanized at the same time as the sheet-like blanket is attached and vulcanized.

The compressive elastomer is made by adding non-expanded balloons or expanded balloons to the elastomer compound similar to that used for the adhesive layers 3*b*, 3*f*, 3*h* and applying the vulcanization process. Compressive property may also be rendered by using a foaming agent and expanding during vulcanization. Among these methods, use of the expanded micro-balloons is more preferable because it does not have adverse effect of gas generation on the adhesive layer of the sheet-like blanket. Compressive elastomer of open-cell structure may also be formed by extraction process. The seam is preferably filled. The filling elastomer is preferably compressive, having compressive property of a degree similar to or less than that of the sheet-like blanket that is attached. Void ratio may be in a range from 20 to 60%, but is preferably from 30 to 50%. When the void ratio is too high, strength of the rubber decreases thus making breakage more likely to occur due to the shear deformation generated during rotation for printing, resulting in shorter service life of the blanket. When a compressive elastomer is used, durability is maintained even during high-speed printing, and breakage is less likely to occur while showing high conformity to various deformations generated during printing.

The additives added to the unvulcanized rubber in the present invention include, for example, fillers, plasticizers, antioxidants, vulcanizers, vulcanization accelerators, auxiliary vulcanization accelerators, vulcanization retardants and vulcanization modifiers. The amount of these additives may be similar to those employed in the prior art. Specifically, the amount preferably to be added to 100 weight part of the unvulcanized rubber are 30 to 100 weight part of the such as carbon black, 0.5 to 1.5 weight part of the plasticizer such as stearic acid, 1 to 4 weight part of the antioxidant, 0.5 to 3 weight part of the vulcanizer such as sulfur, 0.5 to 3 weight part of the vulcanization accelerator (when two or more kinds are used, 0.5 to 3 weight part each), 3.0 to 5.0 weight part of the auxiliary vulcanization accelerator such as zinc oxide, and 0 to 0.5 weight part of the vulcanization retardant.

Manufacturing Process

An example of manufacturing process for the cylindrical printing blanket of the present invention is shown in Table 1.

TABLE 1

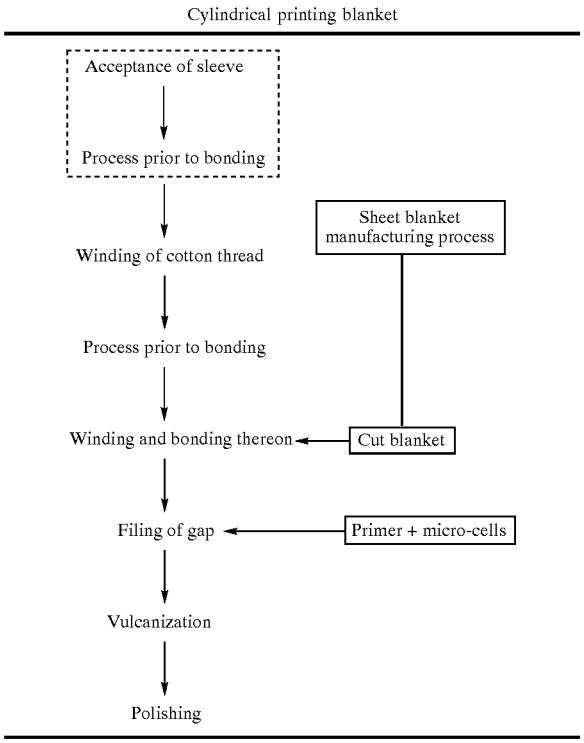

As shown in Table 1, after carrying out a process including the acceptance of the sleeve and pretreatment thereof and a process of making the sheet-like blanket separately, a process of bonding the sheet-like blanket to the sleeve can be carried out.

The sheet-like blanket of the present invention comprises the fabric layer 5*a*, the compressive layer 6 and the surface printing rubber layer 7, while the compressive layer 6 and the surface printing rubber layer 7 are laminated via the fabric layer 5*b*.

The sheet-like blanket is made by cutting a long sheet, that has been made in a separate known process, into predetermined size and bonding it to the outer surface of the sleeve. It may also be manufactured by laminating the constituent members successively as the case requires it.

The gapless printing blanket of the prior art is manufactured in a process as shown in Table 2.

TABLE 2

Gapless

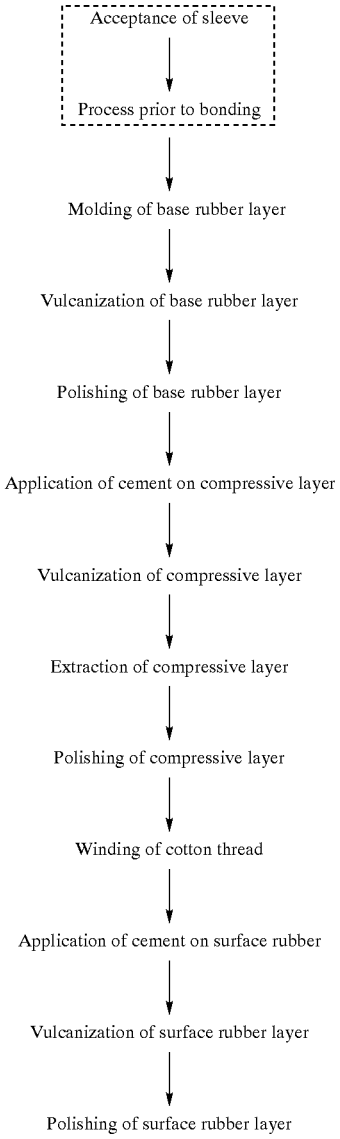

As will be apparent from the comparison of both manufacturing processes, manufacturing efficiency of the printing blanket 1 of the present invention can be improved since the sheet-like blanket member can be made in a separate process and pooled.

The gapless printing blanket of the prior art, on the other hand, must be manufactured in a single stream of process from the acceptance of the sleeve through the completion of the product. Thus scheduling of the manufacturing operations must be rigid, making it difficult to improve the manufacturing efficiency.

The printing blanket of the present invention is made by bonding the sheet-like blanket to the outer surface of the cylindrical sleeve, as described above. Very high printing performance and durability can be achieved, and high quality of printing is obtained over a wide range from ordinary printing to high-speed-printing.

Moreover, the printing blanket of the present invention can be manufactured with high productivity and lower manufacturing cost, and can be easily mounted on a printing press.

EXAMPLES

The following Examples and Comparative Examples further illustrate the present invention in detail.

Example 1

Production of Sleeve 2 and Adhesive Layer

The sleeve 2 made of nickel measuring 169.5 mm in inner diameter, 910 mm in length and 0.15 mm in thickness (manufactured by Taiyo Kogyo K.K.) was mounted on a vulcanization mandrel having a mechanism for installing and removing the sleeve by means of pressurized gas similar to the blanket cylinder described previously. Lord Chemical Inc's Chemlock 205 was applied to the outer surface of the sleeve and dried, followed by the application and drying of Chemlock 252X, thereby forming the adhesive layer of two-layer structure consisting of the adhesive layer 3*a* (laminate of Chemlock 205 and Chemlock 252X, 0.02 mm thick) and 3*b* (formed by coating the Chemlock 252X layer with an adhesive rubber having composition shown in Table 3 formed thereon to a thickness of 0.01 mm with a roller coater).

Production of Long Sheet-Like Blanket S

Process A: Bonding of Fabric Layer 5*b* and Compressive Layer 6

An adhesive layer 3*g* was formed on the surface of a base fabric (made of cotton with dimensions of 910 mm in width, 0.23 mm in thickness and 24 m in length) that makes the fabric layer (5*b*), by coating with a rubber cement which included unvulcanized synthetic rubber having the composition shown in Table 3 by means of a doctor blade, and drying in air for one hour.

Rubber cement for adhesive layer

| (Components) | (Parts by weight) |
|---|---|
| Unvulcanized NBR | 90 |
| Unvulcanized CR | 10 |
| Clay filler | 70 |
| Stearic acid (plasticizer) | 1 |
| Phenolic antioxidant | 1 |
| Powdered sulfur (vulcanizing agent) | 1 |
| Guanidine vulcanization accelerator | 1 |
| Sulfenamide vulcanization accelerator | 1 |
| Zinc oxide (auxiliary vulcanization accelerator) | 5 |
| Thermosetting resin (adhesive) | 5 |
| Magnesium oxide | 3 |
| Toluene (solvent) | 100 |

The compressive layer 6 was formed on the adhesive layer 3*g* by coating with an unvulcanized rubber cement for compressive rubber layer having the composition shown in Table 4 by means of a doctor blade, and drying in air for 12 hours. This long sheet was taken up around a drum (500 mm in diameter), and vulcanized in a vulcanization vessel (1000×2000 mm, manufactured by KANSAI ROLL Co., Ltd.) for 90 minutes at a temperature of 140° C. under a pressure of 3 Kg/cm$^2$.

TABLE 4

Rubber cement for compressive layer

| (Components) | (Parts by weight |
|---|---|
| Unvulcanized NBR | 100 |
| Furnace black (filler) | 30 |
| Clay filler | 40 |
| Stearic acid (plasticizer) | 1 |
| Phenolic antioxidant | 1 |
| Powdered sulfur (vulcanizing agent) | 2.5 |
| Sulfenamide vulcanization accelerator | 1.5 |
| Thiuram vulcanization accelerator | 1 |
| Zinc oxide (auxiliary vulcanization accelerator) | 5 |
| Sodium chloride | 50 |
| Toluene (solvent) | 100 |

Then after being immersed in warm water of 70° C. for 12 hours to remove common salt by dissolving, the sheet was heated to dry at 100° C. for 60 minutes in an oven. Then the sheet was polished on the surface thereof with a long sheet polishing machine (manufactured by Sumitomo Rubber Industries Co., Ltd.) thereby forming the porous compressive layer 6 of open-cell structure having thickness of 0.3 mm (dimensional tolerance within ± 0.01 mm) and void ratio of 35%. Thus such a sheet-like member was obtained as the fabric layer 5*b* (0.23 mm) and the compressive layer 6 (0.30 mm) were laminated via the adhesive layer 3*g* (0.01 mm).

Process B: Adhesion of a Plurality of Fabric Layers 5*a*

Three sheets of base fabric similar to that of process A (except that thickness is 0.30 mm) were prepared. The first base fabric was coated with the rubber cement for the adhesive layer shown in Table 3 by means of a doctor blade and dried in air for one hour, thereby making the first fabric layer 5*a* having the adhesive layer 3*e*. The second base fabric was laminated on this sheet via an adhesive layer 3*e*, and the third base fabric was laminated on this sheet via an adhesive layer 3*d*, thus making the sheet-like member consisting of the three fabric layers 5*a*.

Process C: Bonding of Sheet-Like Member

The sheet-like member made in the process A was coated on the compressive layer side with an adhesive agent having the composition shown in Table 3 by means of a doctor blade to a thickness of 0.01 mm, and was dried in air for one hour. Then the laminate of the fabric layer 5*a* obtained in the process B was laminated, bonding the sheet-like members.

Process D: Formation of Surface Printing Layer

The sheet-like member combined in the process C was coated on the fabric layer 5*b* side thereof with a rubber cement for the adhesive layer having the composition shown in Table 3 by means of the doctor blade described above and was dried in air for 30 minutes, thereby forming the adhesive layer 3*h* (thickness 0.01 mm).

The adhesive layer 3*h* was coated with a rubber cement for the surface printing rubber layer having the composition shown in Table 5 by means of a doctor blade, and was dried in air for 12 hours. This long sheet was taken up around a drum (500 mm in diameter), and vulcanized in a vulcanization vessel for 90 minutes at a temperature of 140° C. under a pressure of 3 Kg/cm$^2$. Surface of the long sheet after vulcanization was subjected to buffing (grinding wheel) with a long sheet polishing machine (manufactured by Sumitomo Rubber Industries Co., Ltd.) thereby controlling the sheet thickness to 2.00 mm.

The sheet-like blanket member S having the fabric layers, the compressive layer and the surface printing layer was made as described above.

TABLE 5

Rubber cement for surface printing layer

| (Components) | (Parts by weight) |
|---|---|
| Unvulcanized NBR | 100 |
| Clay filler | 40 |
| Stearic acid (plasticizer) | 1 |
| Process oil (plasticizer) | 5 |
| Powdered sulfur (vulcanizing agent) | 0.5 |
| Thiuram vulcanization accelerator | 1 |
| Zinc oxide (auxiliary vulcanization accelerator) | 5 |
| Thermosetting resin (adhesive) | 3 |
| Quinoline compound | 1 |
| Toluene (solvent) | 100 |

Bonding of the Sheet-Like Blanket to Sleeve

The long sheet-like blanket member obtained as described above was cut to the size of the outer circumference of the sleeve 2 and was bonded thereto. The sheet that was cut was bonded to have a seam 8*a* of about 1 mm on the circumference of the sleeve.

Filling of Seam

After bonding the sheet-like blanket, the seam 8 was filled with a rubber cement made by mixing micro-balloons in the rubber cement for the adhesive layer shown in Table 3 (proportions of rubber cement of Table 3 to micro balloons being 100 to 10 by weight), and vulcanized in the vulcanization vessel described above for 90 minutes at a temperature of 140° C. under a pressure of 3 Kg/cm$^2$. Then the surface was polished with the cylindrical grinder described previously, to form the surface printing layer having uniform thickness of 0.25 mm (dimensional tolerance within ±0.01 mm) and surface roughness Rz in a range from 3 to 5 $\mu$m in terms of ten-point average roughness.

The process described above completed the cylindrical printing blanket of the present invention comprising the seamless sleeve with the sheet-like blanket having the fabric layer, the compressive layer and the surface printing rubber layer being bonded on the outer surface thereof.

Examples 2 to 25

In Example 1, after forming the adhesive layer 3*b* on the sleeve 2, a cotton thread having a predetermined diameter was wound in spiral while applying a predetermined tension. Space between adjacent turns of the thread was kept within 0.05 mm. A cylindrical body forming machine (manufactured by Sumitomo Rubber Industries Co., Ltd.) was used to wind the cotton thread.

A cylinder of diameter a little smaller than that of the printer cylinder, namely a cylinder having a predetermined interference, was prepared. After forming the adhesive layer 3*b* on the cylinder and temporarily mounting a sleeve thereto, the thread layer was formed with the predetermined tension in the process described above.

The operation described above was carried out under the conditions of thread tension, interference and thread diameter shown in Table 6.

Then the surface of the wound cotton thread was coated with the rubber cement 3*c* of the composition shown in Table 3 with a roller coater.

The cylindrical printing blankets of Examples 2 to 25 were made in the same process as in Example 1 except for using the sleeve made as described above.

TABLE 6

| Example | Thread tension | Interference (%) | Thread diameter (mm) | Amount of slip (mm) | Mountability (minutes/piece) |
|---|---|---|---|---|---|
| 1 | — | — | — | 1.5 | 1 |
| 2 | 400 | 0.5 | 0.3 | 0.15 | 1 |
| 3 | 400 | 0 | 0.3 | 1 | 1 |
| 4 | 400 | 0.02 | 0.3 | 0.6 | 1 |
| 5 | 400 | 0.05 | 0.3 | 0.3 | 1 |
| 6 | 400 | 0.1 | 0.3 | 0.25 | 1 |
| 7 | 400 | 0.3 | 0.3 | 0.2 | 1 |
| 8 | 400 | 0.8 | 0.3 | 0.13 | 2 |
| 9 | 400 | 1 | 0.3 | 0.12 | 3 |
| 10 | 400 | 1.2 | 0.3 | 0.11 | 5 |
| 11 | 50 | 0.5 | 0.3 | 0.48 | 1 |
| 12 | 100 | 0.5 | 0.3 | 0.35 | 1 |
| 13 | 200 | 0.5 | 0.3 | 0.22 | 1 |
| 14 | 300 | 0.5 | 0.3 | 0.17 | 1 |
| 15 | 500 | 0.5 | 0.3 | 0.14 | 1.5 |
| 16 | 700 | 0.5 | 0.3 | 0.13 | 2 |
| 17 | 800 | 0.5 | 0.3 | 0.12 | 3 |
| 18 | 1000 | 0.5 | 0.3 | 0.11 | 5 |
| 19 | 400 | 0.5 | 0.1 | 0.12 | 3 |
| 20 | 400 | 0.5 | 0.15 | 0.13 | 2 |
| 21 | 400 | 0.5 | 0.2 | 0.14 | 1 |
| 22 | 400 | 0.5 | 0.4 | 0.25 | 1 |
| 23 | 400 | 0.5 | 0.6 | 0.55 | 1 |
| 24 | 400 | 0.5 | 0.8 | 0.74 | 1 |
| 25 | 400 | 0.5 | 1 | 1 | 1 |

Thread winding cylinder interference (%) = {[(Printer cylinder diameter) − (Thread winding cylinder diameter)]/(Printer cylinder diameter)} × 100

Example 26

After bonding the sheet-like blanket to the sleeve (without thread layer) in the same manner as in Example 1, the seam was filled with a non-compressive elastomer (void ratio 0%) of the composition shown in Table 3, thereby making the cylindrical printing blanket.

Example 27

The cylindrical printing blanket was made in the same procedure as in Example 26 except for using the sleeve having the thread layer formed thereon.

Example 28

The cylindrical printing blanket was made in the same manner as in Example 26 except for leaving the seam of the sheet-like blanket without being filled.

Example 29

The cylindrical printing blanket was made in the same manner as in Example 27 except for leaving the seam of the sheet-like blanket without being filled.

Examples 30 to 35

The cylindrical printing blankets were made in the same manner as in Example 2 except for filling the seam with the compressive elastomer having void ratios of 10%, 20%, 30%, 50%, 60% and 70%.

Comparative Example 1

A sheet-like blanket was made by laminating a surface printing rubber layer (0.45 mm), a base fabric layer (0.25 mm), a compressive layer (0.30 mm) and three base fabric layers (0.30 mm) in this order. The same materials as those used in Example 1 were used. The sheet thus obtained was wound around the cylinder of the printing press, while tabs attached to both ends thereof are fitted in a gap provided in the cylinder. The sheet was fastened onto the cylinder by pulling the tabs with a take-up mechanism incorporated in the cylinder, thereby applying a tension to the blanket.

Comparative Example 2

A printing blanket was made by successively forming a sleeve (0.15 mm), a base layer (1.25 mm), a compressive layer (0.3 mm), a thread layer (0.3 mm) and a surface printing layer (0.2 mm) by the method of Example 3 disclosed in Japanese Published Unexamined Patent Application (Kokai Tokkyo Koho Hei) No. 8-216548. The layers were formed from materials similar to those used in Example 1.

The base layer was made of the compound shown in Table 7.

TABLE 7

Rubber cement for base layer

| (Components) | (Parts by weight) |
|---|---|
| Unvulcanized NBR | 100 |
| Furnace black (filler) | 60 |
| Silica filler | 40 |
| Stearic acid (plasticizer) | 1 |
| Aromatic oil (plasticizer) | 10 |
| Amine antioxidant | 1.5 |
| Powdered sulfur (vulcanizing agent) | 2.5 |
| Guanidine vulcanization accelerator | 1 |
| Sulfenamide vulcanization accelerator | 0.5 |
| Zinc oxide (auxiliary vulcanization accelerator) | 5 |
| Phthalic anhydride (vulcanization retardant) | 0.5 |

Evaluation Test

Measurement of Amount of Set in Fatigue

The amount of set in fatigue (mm) was measured on the printing blankets of the Examples and Comparative Examples, by the method described in Japanese Published Unexamined Patent Application (Kokai Tokkyo Koho Hei) No. 8-216548. Based on the results of this measurement, durability of the printing blankets of the Examples and Comparative Examples was evaluated. It will not be necessary to point out that the less the amount of set in fatigue, the better the durability of the printing blanket.

Specifically, with the drum pressed against the printing blanket B with a depression of 0.15 mm, a drive shaft 5 was rotated at a speed of 1300 rpm continuously for 100 hours, and the decrease (mm) in the thickness of the blanket was measured and taken as the amount of set in fatigue.

Printing Test

Printing tests were carried out at the rotating speeds shown in Table 9 using a gapless printing press with the plate cylinder being pressed against the blanket cylinder with a depression of 0.15 mm.

Amount of Slip

The amount of slip was measured using a tester similar to that used in the measurement of set in fatigue, after rotating continuously for 500,000 cycles at a speed of 1300 rpm with depression of 0.15 mm. Specifically after aligning a reference line provided on the blanket cylinder with the seam of the blanket, the cylinder was rotated for 500,000 cycles, and then the amount of deviation between the seam and the reference line of the blanket cylinder was measured.

Comparison of Structure and Characteristics

Comparison of structure and characteristics among the printing blankets of Comparative Examples 1, 2, Examples 1, 2 and Examples 26 to 35 is shown in Table 8 and Table 9.

Figure 3:
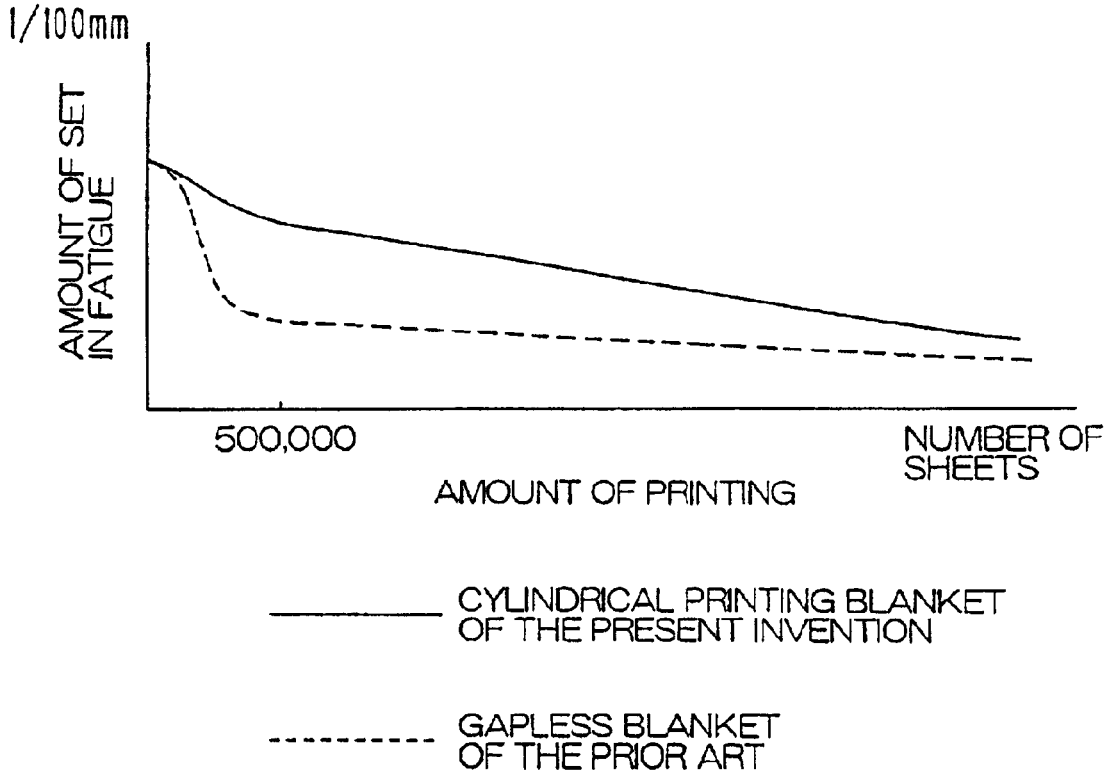
FIG. 3 is a graph schematically showing the comparison of the relationship between the amount of printing and set in fatigue between the printing blanket according to the present invention and the gapless printing blanket of the prior art.

In Table 8, Comparative Example 2 that is the cylindrical printing blanket of the prior art experienced quicker setting of the upper layer due to creep since the thread layer formed over the compressive layer and below the printing layer by winding the thread while applying tension generates a compressive stress in the layers below the compressive layer. The cylindrical printing blanket of the present invention, on the other hand, does not experience early set in fatigue since the compressive layer is not subject to excessive stress. Comparison of the amount of set in fatigue is shown in FIG. 3.

TABLE 8

| | Comparative Example 1 | Comparative Example 2 | Example 1 | Example 2 |
|---|---|---|---|---|
| Structure | Conventional sheet-like PB | Gapless type | Cylindrical PB bonding type | Cylindrical PB bonding type (with thread layer) |
| Characteristics | | | | |
| Time required to mount | 30 minutes/sheet | 1 minute/piece | 1 minute/piece | 1 minute/piece |
| Thread streak | None | Present | None | None |
| Set in fatigue | 5/10 mm | 4/100 mm | 1/100 mm | 1/100 mm |

Note
*PB: Printing blanket
*Thread streak: Last printed matter of 20 million sheets printed after mounting the PB on a printing press was checked to see whether thread streaks were shown in the printed image.
*Set in fatigue: Change in thickness when 500,000 sheets have been printed after mounting the PB on a printing press.

TABLE 9

| Example No. | Presence thread layer | Filler in seam | Void ratio of filler (%) | Durability 1300 rpm Rotating speed | Durability 700 rpm Rotating speed | Reason for replacement | Durability/ cost |
|---|---|---|---|---|---|---|---|
| 1 | No | Compressive | 40 | 23.8 million sheets | 24.6 million sheets | Set in fatigue | ○ |
| 2 | Yes | Compressive | 40 | 24.7 million sheets | 25.5 million sheets | Set in fatigue | ○ |
| 30 | Yes | Compressive | 10 | 21.1 million sheets | 23.0 million sheets | Set in fatigue | ○ |
| 31 | Yes | Compressive | 20 | 23.1 million sheets | 24.4 million sheets | Set in fatigue | ○ |
| 32 | Yes | Compressive | 30 | 24.4 million sheets | 25.4 million sheets | Set in fatigue | ○ |
| 33 | Yes | Compressive | 50 | 24.5 million sheets | 25.2 million sheets | Set in fatigue | ○ |
| 34 | Yes | Compressive | 60 | 23.9 million sheets | 24.7 million sheets | Set in fatigue | ○ |
| 35 | Yes | Compressive | 70 | 22.6 million sheets | 23.4 million sheets | Set in fatigue | ○ |
| 26 | No | Non-compressive | 0 | 20.3 million sheets | 22.6 million sheets | Set in fatigue | ○ |
| 27 | Yes | Non-compressive | 0 | 21.0 million sheets | 22.8 million sheets | Set in fatigue | ○ |
| 28 | No | No filler | 100 | 16.2 million sheets | 18.4 million sheets | Peel off | ○ |
| 29 | Yes | No filler | 100 | 16.5 million sheets | 19.2 million sheets | Peel off | ○ |
| Comp. Example | | | | | | | |
| 1 | * | — | — | — | 21.1 million sheets | Set in fatigue | ○ |
| 2 | ** | None | — | 21.4 million sheets | 22.2 million sheets | Set in fatigue and thread streak | × |

Symbols and terms used in Table 9 have the following meaning.
*: Sheet blanket of the prior art
**: Gapless type
Peel: The sheet-like blanket that had been bonded peeled off.
Compressive: The filler is a compressive elastomer.
Non-compressive; The filler is a non-compressive elastomer.
○: Better than Comparative Example 2.

The disclosures of Japanese Patent Application Nos. 11-257538 and 2000-216210, filed on Sep. 19, 1999 and Jul. 17, 2000, respectively, are incorporated herein by reference.

What is claimed is:

1. A process for manufacturing a cylindrical printing blanket, which comprises the steps of (1) preparing an elongated sheet-like blanket having an innermost fabric layer, a surface printing layer, and a compression layer intermediate said fabric layer and said surface printing layer (2) cutting said sheet-like blanket into predetermined size, and (3) bonding said innermost fabric layer of said cut blanket onto an outer surface of a seamless sleeve via a thread layer spirally wound on an adhesive elastomer layer.

2. The process according to claim 1, wherein said thread is spirally wound on said sleeve mounted on a cylinder, said cylinder having a diameter of from 0.5 to 1.0% smaller than the diameter of a printing press cylinder upon which said printing blanket is to be mounted, with the diameter of said sleeve being equal to or slightly smaller than the diameter of said cylinder.

3. The process according to claim 1, wherein said sheet-like blanket on said sleeve has a seam which is sealed to prevent liquid from permeating therethrough.

4. The process according to claim 3, wherein said seam is sealed by applying a cover thereover.

5. The process according to claim 3, wherein said seam is sealed by filling with an elastomer.

6. The process according to claim 5, wherein said seam is filled with a compressive elastomer.

7. The process according to claim 1, wherein a additional fabric layer is provided between said compression layer and said surface printing layer.

* * * * *